US006311875B1

(12) United States Patent
Anderson et al.

(10) Patent No.: US 6,311,875 B1
(45) Date of Patent: Nov. 6, 2001

(54) PRESSURIZED TANK DISPENSER ASSEMBLY

(75) Inventors: William C. Anderson, Blair, NE (US); Bryan J. Gran, Thousand Oaks, CA (US); Todd Bolzer, Jonesboro, AK (US)

(73) Assignee: Snyder Industries, Inc., Lincoln, NE (US)

( * ) Notice: Subject to any disclaimer, the term of this patent is extended or adjusted under 35 U.S.C. 154(b) by 0 days.

(21) Appl. No.: 09/543,594

(22) Filed: Apr. 5, 2000

(51) Int. Cl.[7] ..... B65D 83/00; B65D 83/06; B65D 83/14

(52) U.S. Cl. ..... 222/396; 222/400.7

(58) Field of Search ..... 222/400.7, 396; 137/493.8, 522, 901, 377, 382; 217/101

(56) References Cited

U.S. PATENT DOCUMENTS

| | | | | |
|---|---|---|---|---|
| D. 326,503 | | 5/1992 | Ipsen | D23/233 |
| D. 328,200 | | 7/1992 | Ipsen | D7/398 |
| 770,043 | * | 9/1904 | Bode et al. | 137/522 |
| 3,670,929 | * | 6/1972 | Berry | 222/400.7 |
| 4,606,367 | * | 8/1986 | Britt | 137/901 |
| 4,721,129 | * | 1/1988 | Sousa | 137/377 |
| 5,054,511 | * | 10/1991 | Tuan et al. | 137/493.8 |
| 5,242,092 | | 9/1993 | Riis et al. | 222/400.7 |
| 5,246,140 | | 9/1993 | Thix et al. | 222/4 |
| 5,617,977 | | 4/1997 | Augustinus | 222/400.7 |
| 5,653,253 | | 8/1997 | Larsen | 137/315 |
| 5,713,496 | | 2/1998 | Ipsen | 222/400.7 |
| 5,901,747 | | 5/1999 | Rokkjaer | 137/614.2 |
| 5,944,229 | | 8/1999 | Rokkjaer | 222/153.07 |

OTHER PUBLICATIONS

Snyder Industries, Inc. "Snyder AG Chem Tanks" product literature in color, Lincoln, Nebraska, 4 pages, no publication date given.

Transpak 120, Micro Matic USA, Inc., Northridge, California, (Snyder Industries, Inc., Lincoln, Nebraska), single double–sided sheet, product literature No. 236, Jan. 1999.

Transpak 120, Micro Matic USA, Inc., Northridge, California, (Snyder Industries, Inc., Lincoln, Nebraska), single double–sided sheet, product literature No. 20–640, Dec. 1999.

Micro Matic Group, "Connection" and "Disconnection," single undersized black and white sheet, product literature No. 235/May 1995.

Micro Matic Group, "Installation Manual for MacroValve," on Liquid Transfer Valve Systems, literature No. 233, no date given.

MacroValve MAV publication on "Liquid Transfer Valve System–a Clear Commitment to the Environment," published by Micro Matic Group, no date given.

"Servicing of MacroValve" regarding "Liquid Transfer Valve Systems," published by Micro Matic Group, no date given.

* cited by examiner

*Primary Examiner*—Kevin Shaver
*Assistant Examiner*—Stephanie L. Willatt
(74) *Attorney, Agent, or Firm*—Hovey, Williams, Timmons & Collins

(57) ABSTRACT

A pressurized tank dispenser assembly generally includes an extractor valve and a relief valve component mounted on a common fitting which may be held to a tank by a securement ring. The extractor valve permits pressurizing the tank and dispensing liquid by the attachment of a coupler thereon without the need for tools, while the relief valve component includes both vacuum relief and overpressure relief valves. The fitting is attached to the tank by the annular securement ring, whereby only a single opening through the tank is necessary to perform all operating functions of the tank.

20 Claims, 3 Drawing Sheets

PRESSURIZED TANK DISPENSER ASSEMBLY

BACKGROUND OF THE INVENTION

1. Field of the Invention

The present invention concerns a pressurized tank dispenser assembly for discharging liquids from a tank. More particularly, it is concerned with a pressurized tank dispenser assembly having a liquid extractor valve and pressure relief vent on the same fitting.

2. Description of the Prior Art

Tanks which are used for transporting and delivering liquids under pressure are known and used, for example, in the beverage industry. Typically, the liquids contained in the vessel or tank receive pressure, such as air or carbon dioxide to assist in dispensing the liquid. An extractor valve on the tank may be fitted with a coupler which, when connected, opens the valve and permits the liquid therein to be discharged. It is particularly beneficial if the tank valve shuts off upon removal of the coupler, so that no additional liquid escapes. When beverages or hazardous chemicals are contained in the tank, minimizing such leakage avoids contamination or exposure of the user to hazardous chemicals. Various valves and dispensing couplers for use with a pressurized tank are shown, for example, in U.S. Pat. Nos. 5,242,092, 5,246,140, 5,653,253, 5,713,496, 5,901,747, 5,944,229, U.S. Pat. No. Des. 326,503 and U.S. Pat. No. Des. 328,200, the disclosures of which are incorporated herein by reference.

However, there is a need for a simplified dispenser which may be readily attached and removed from the tank. When bulk chemicals such as liquid fertilizer, insecticide, herbicide or the like used by farmers are contained in the tank, existing pressurized liquid dispensers may be difficult to remove for refilling. Moreover, when relief valves for permitting venting of excess air or entry of air to prevent a vacuum are separate from the dispensing valve, additional time is required for removal and installation of the several valves on the tank, and the separate valves may be misplaced or damaged.

SUMMARY OF THE INVENTION

The present invention provides a significant advantage over prior pressurized tank dispensers by having a simple to install and remove dispenser which includes in a single fitting both a liquid extractor valve and a pressure relief valve. The dispenser may thereby be attached as a single unit and coupled to the tank through a single securement member.

In greater detail, the dispenser assembly preferably includes an extractor valve which is configured to both discharge liquid and receive pressurized gas therethrough, a relief valve for preventing over pressurization of the tank, and a fitting adapted for mounting to the tank and connecting both the dispenser valve and the relief valve thereto. The fitting is configured for mounting to a neck of the tank, and may be readily secured in place by a securement member complementarily configured to the neck. The tank wall is preferably rotationally molded to present only a single hole therethrough which is within the neck. The extractor valve is preferably configured to receive a coupler thereon which requires no tools for attachment and both selectively discharges liquid under pressure within the tank and allows attachment of a source of pressurized gas. The relief valve is positioned on the fitting so as to avoid interference with the operation of the coupler but nonetheless permit good venting of the tank when overpressured. The relief valve is further advantageously configured to permit manual actuation as well as automatic overpressure relief, and most preferably to enable admission of air into the tank to enable controlled entry to air and avoid the presence of a partial vacuum.

The fitting is preferably configured as a plate which may be flat or domed, but sits atop the neck and sealed by a gasket. The fitting is quickly and easily attached and removed by a securement member configured as a ring which permits the relief valve and dispenser valve to extend upwardly therethrough. Preferably, the tank has a neck which is externally threaded and complemental to the internally threaded securement ring, whereby attachment of the pressurized tank dispenser may be accomplished by merely placing the fitting on the gasket residing on the neck and threading the securement ring thereon.

In an alternate embodiment, the pressurized tank dispenser also includes a receiver for the intake of pressurized gas directly through the fitting. The placement of the receiver, for example a quick-connect pneumatic coupler, on the fitting and as a part of the dispenser assembly enables the tank to be pressurized without the need of attaching the coupler to the extractor valve. In this manner, the tank may be pressurized while the coupler is attached to another tank, thereby reducing preparation time or the need for multiple couplers.

It may thus be appreciated that the pressurized tank dispenser avoids undesired separation of the relief valve and extractor valve, provides a single part for installation and removal, and quick and easy attachment of the coupler without the need for tools. These and other advantages will be readily appreciated by those skilled in the art with reference to the description of the preferred embodiments and the drawings provided herewith.

BRIEF DESCRIPTION OF THE DRAWINGS

Referring now to the drawings, a pressurized tank dispenser assembly 10 in accordance with the present invention is designed for removable mounting to a tank 12, and broadly includes a liquid extractor valve 14, a relief valve component 16, a fitting 18, a gasket 20 and a securement ring 22 as shown in FIGS. 1 and 2. The extractor valve 14 and the relief valve component 16 are both mounted on the fitting 18 whereby placement of the fitting on the neck 112 of the tank 12 serves to locate both the extractor valve 14 and the relief valve 16 and by threading the securement ring 22 on the neck 24, are commonly and simultaneously installed. A coupler 126 is provided which mounts to the extractor valve 14 without the need for any tools and permits both pressurization of the tank 12 and selective opening of the extractor valve 14 to remove liquid from the tank 12.

DESCRIPTION OF THE PREFERRED EMBODIMENTS

Figure 2:
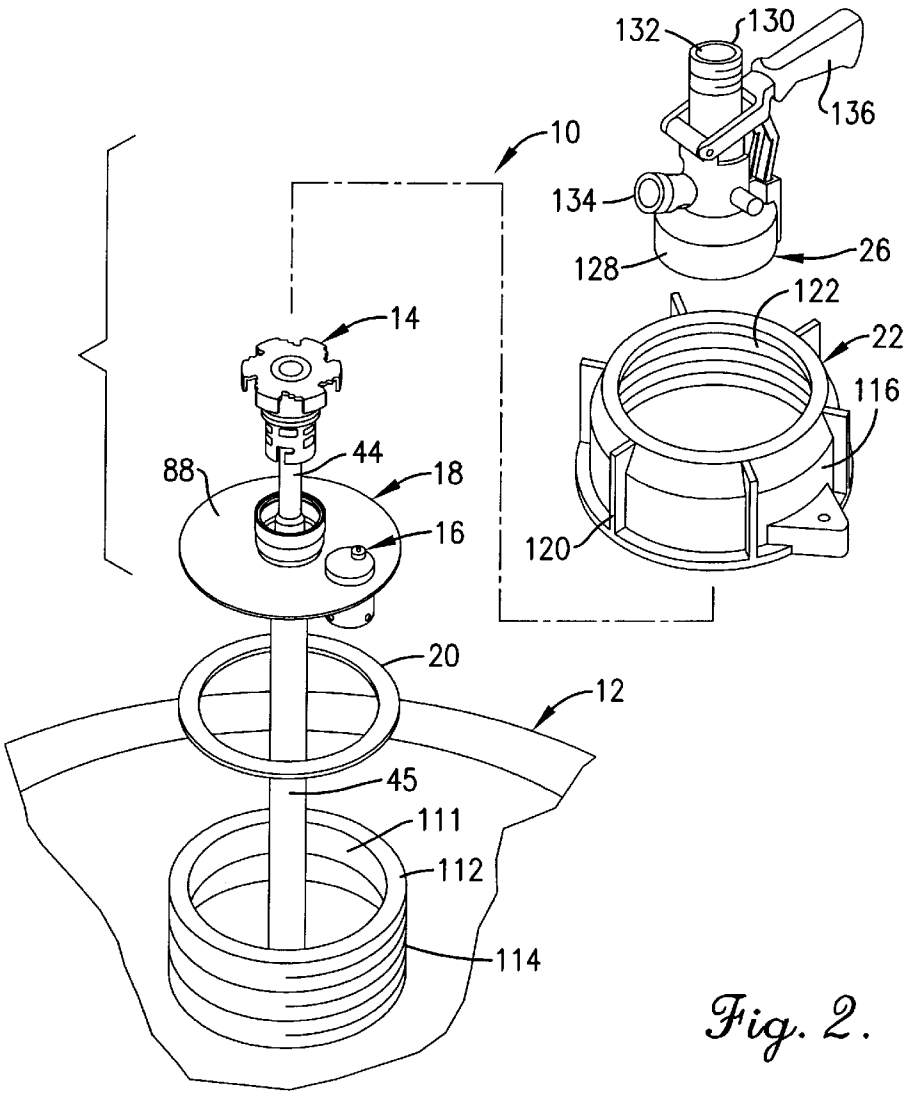
FIG. 2 is an enlarged, exploded view of the dispenser assembly shown in FIG. 1, showing the coupler, the securement ring, the fitting, the dispensing valve and the relief valve positioned for attachment to the neck of the tank.
Figure 1:
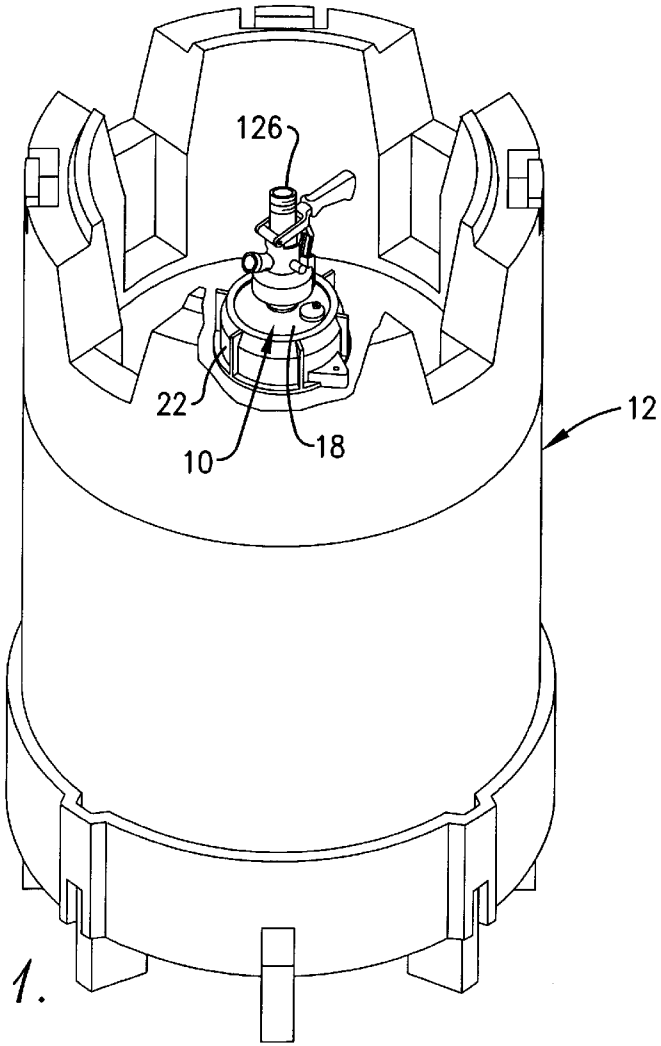
FIG. 1 is a perspective view of the pressurized tank dispenser assembly hereof mounted on a tank, with a coupler attached to the dispenser valve.
Figure 3:
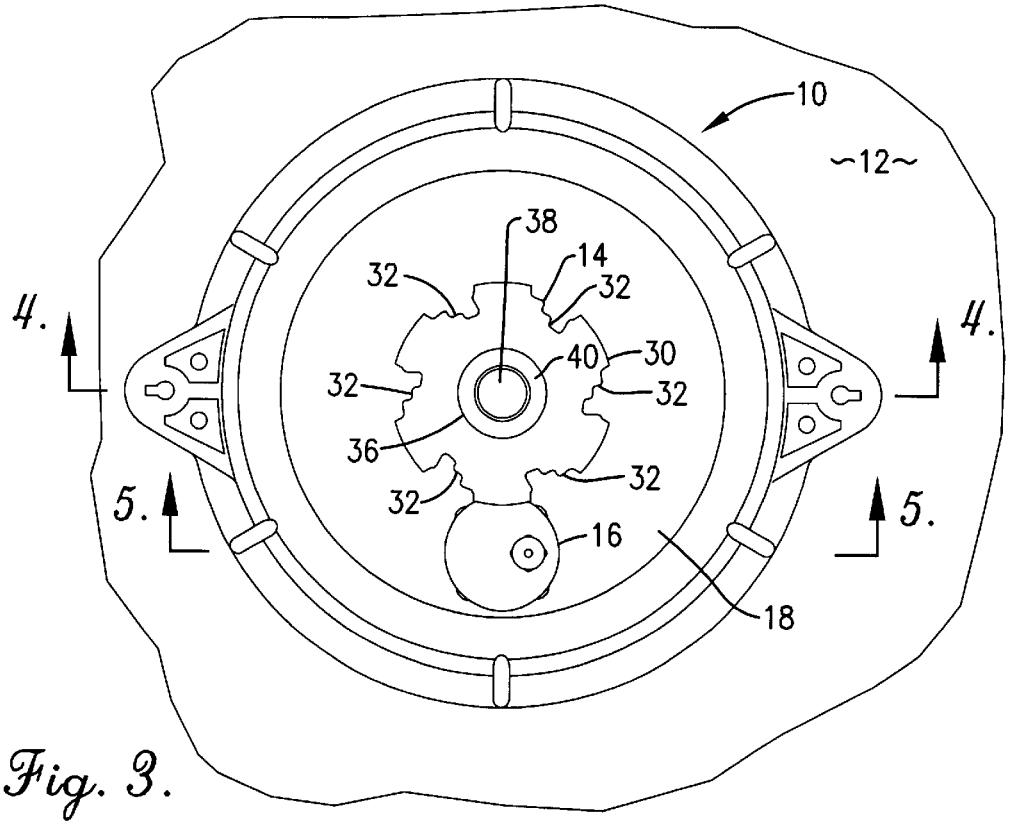
FIG. 3 is a top plan view of the pressurized tank dispenser of FIG. 1 installed on the neck of the tank.

Referring now to the drawings, a pressurized tank dispenser assembly 10 in accordance with the present invention is designed for removable mounting to a tank 12, and broadly includes a liquid extractor valve 14, a relief valve component 16, a fitting 18, a gasket 20 and a securement ring 22 as shown in FIGS. 1 and 2. The extractor valve 14 and the relief valve component 16 are both mounted on the fitting 18 whereby placement of the fitting on the neck 24 of the tank 12 serves to locate both the extractor valve 14 and the relief valve 16 and by threading the securement ring 22 on the neck 24, are commonly and simultaneously installed. A coupler 26 is provided which mounts to the extractor valve 14 without the need for any tools and permits both pressurization of the tank 12 and selective opening of the extractor valve 14 to remove liquid from the tank 12.

Figure 4:
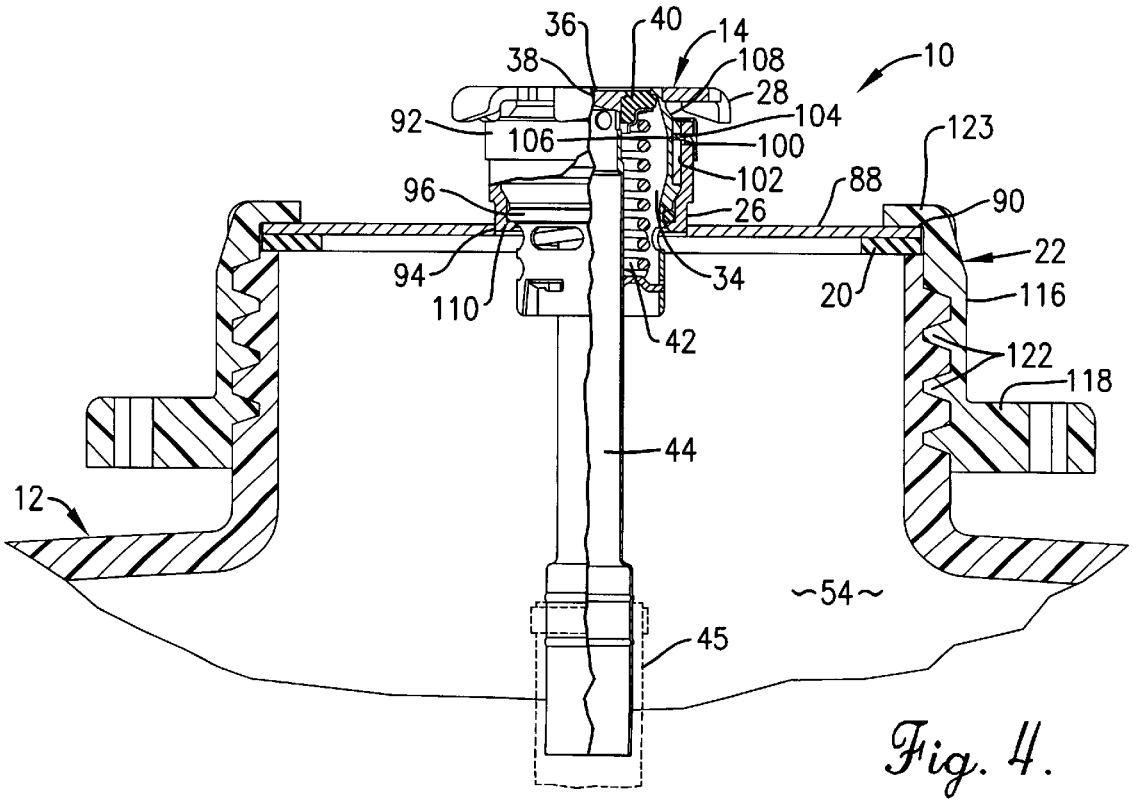
FIG. 4 is a vertical sectional view taken along line 4—4 of FIG. 3, showing the draw tube within the tank connected to the dispensing valve.

In greater detail, one extractor valve 14 which is particularly suitable for use in the present invention is a model RS-MV available from Micro Matic, Inc. of Micro Matic U.S.A., Inc. of Northridge, Calif. and shown in U.S. Pat. No. 5,713,496, the disclosure of which is incorporated by reference. The extractor valve 14 includes a preferably stainless steel valve body 26 having a coupling head 28 extending radially outwardly and presenting an irregular margin 30 with a plurality of circumferentially spaced ridged indentations 32. The valve body 26 defines a central channel 34 which receives a sealing element 36. The sealing element 36 includes a central, preferably stainless steel disk 38 and a surrounding elastomeric sealing ring 40 of Viton nitrile rubber or EPDM or the like which is biased into sealing relationship with the valve body 26 by a spring 42. A stainless steel extraction tube 44 is fluidically connected to the channel 34, and may be provided with a dip tube extension 45 of flexible plastic or other material as shown in phantom in FIG. 4, the extension permitting the liquid to be drawn from the bottom of the tank 12.

Figure 5:
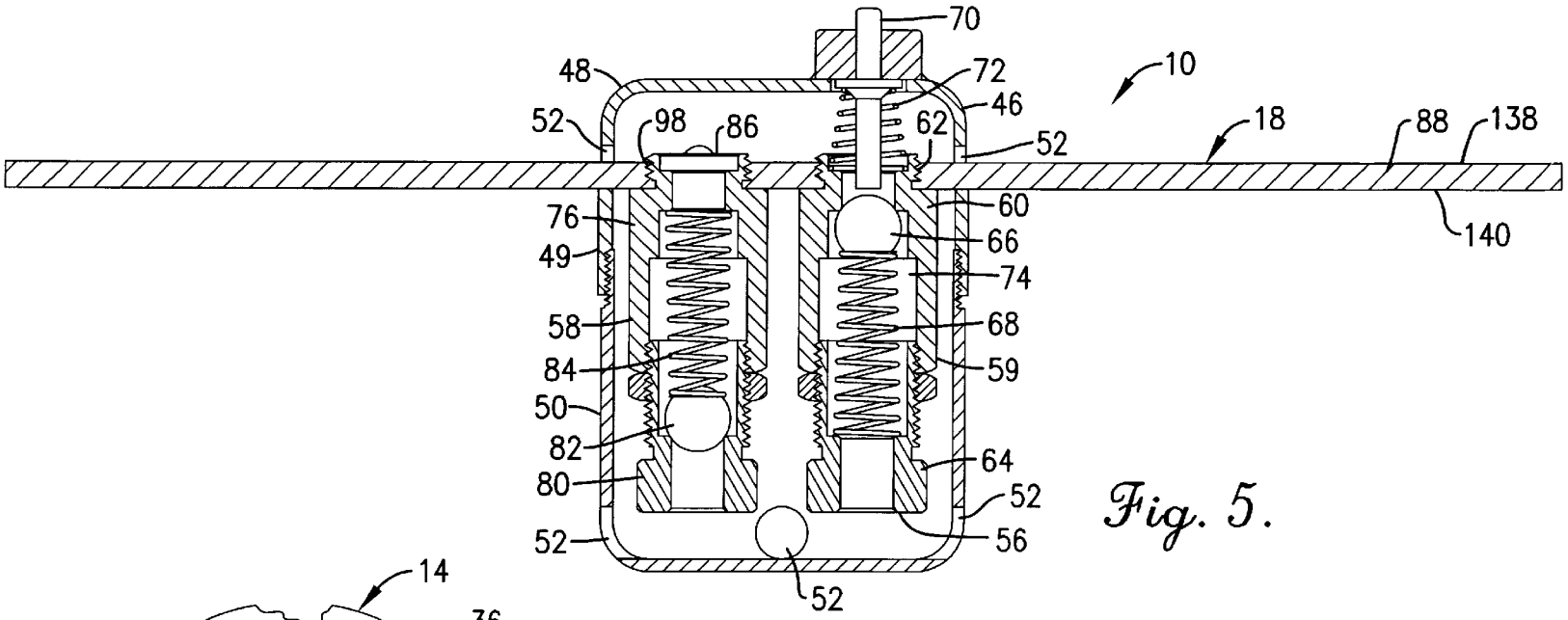
FIG. 5 is an enlarged, vertical sectional view showing the relief valve mounted on the fitting.

The relief valve component 16 is mounted to the fitting 18 and is shown in greater detail in FIG. 5 and includes a housing 46 of stainless steel or the like having an upper section 48 and middle ring 49 welded to the fitting 18, with the middle ring 49 threadably connected to a lower portion 50. Both the upper portion 48 and the lower portion 50 include airways 52 therethrough which fluidically communicate, respectively, with the atmosphere and a fluid storage chamber 54 defined within the tank 12. The housing contains an first relief valve 56 and a second relief valve 58 which are threadably and sealingly coupled to the fitting 18. The first relief valve element 56 includes a tubular valve stem 59 having an upper component 60 with a threaded insert threaded into a first relief valve opening 62 in the fitting 18, and a lower component 64 threaded into the upper component 60. A ball check element 66 is biased upwardly into sealing relationship with the upper component 60 by check spring 68. A manual override pin plunger 70 is mounted to the upper portion 48 of the housing in vertical alignment with the check element 66 and biased upwardly by spring 72 positioned intermediate the upper component 60 and the pin plunger 70. The check element 66 blocks airflow through a passage 74 through the first relief valve element except when a vacuum condition exists, wherein air pressure exerts a force against the ball check element 66 to overcome the compressive force of the spring to permit air to flow downwardly into the fluid storage chamber 54, or when the user desires to vent excess pressure within the chamber 54 by depressing the pin plunger 70 to unseat the ball check element 66 and allow pressurized gas within the chamber 54 to flow out through the housing 46.

The second relief valve 58 of the relief valve component 16 is similar to the first relief valve in that it is tubular and includes an upper component 76 threaded through a second relief valve opening 98 in the fitting 18, and a lower component 78 defining an internal passage 80 containing a second ball check element 82 and a spring 84. However, the spring 84 is positioned between the upper component 76 and the ball check element and thus exerts a downward force to seat the ball check element 82 on the lower component 78 in sealing relationship. An apertured vent cap 86 is securely fitted onto the upper component 76 to hold the spring in compression and permit gas to flow therethrough. The spring 84 is of a higher spring coefficient than spring 68, whereby the tank 12 may be pressurized to about 12 and ½ pounds greater than atmospheric pressure before releasing gas through the second relief valve 58, but spring 68 will unseat at vacuum conditions only slightly below atmospheric pressure.

The fitting 18 preferably includes a flat or slightly domed plate 88 which has a circular outer margin 90 and has a collar 92 fitted into a central opening 94 and valve openings 62 and 98 for receiving the relief valves 56 and 58. The collar 92 includes a circumscribing groove 100 on its inner face 102 to receive therein a retaining ring 104. The valve body 26 includes a corresponding circumferentially extending slot 106 on its outer surface 108, whereby the retaining ring 104 snaps into engagement with both groove 100 and slot 106 to hold the valve body 26 against an O-ring 96 of Viton nitrile rubber or EPDM against a lower, inwardly extending rim 110 of the collar 92. The extractor valve 14 is rotated clockwise under slight downward pressure, and then pressed into the collar 92 until the retaining ring 104 snaps into place. The collar is preferably welded into place in the central opening 94. The first and second relief valves are threaded into the valve openings 62 and 98 and a sealant, such as that sold under the mark Loctite, is applied to ensure a good sealing relationship. The upper section 48 and middle ring 49 are both preferably welded to the plate 88, the latter in airtight relationship.

The annular gasket 20 is of an elastomeric material such as EPDM synthetic rubber and positioned below the plate 88. Preferably, the tank 12 sits in a separate base molded of high density polyethylene, whereby the bottom of the tank 12 may be convex and provided with a central sump to provide maximum utilization of the liquid stored therein. The tank 12 is of a high density polyethylene and preferably rotationally molded to provide a continuous, imperforate wall with only a single hole 111 which is located in an upwardly extending neck 112, the neck having external threads 114 for threadably receiving the securement ring 22 thereon. The neck 112 is sized to receive the gasket 20 thereon. The securement ring 22 has an annular upright wall 116 and a base 118 molded of high density polyethylene. The upright wall 116 has a plurality of circumferentially spaced external ridges 120 and internal threads 122 for threading onto the neck 112. A circumferentially extending radially inwardly oriented lip 123 extends from the upright wall 116 and compresses the plate 88 onto the gasket to provide an air-tight seal. The tank 12 may be further provided with a raised castellated protector (a portion thereof broken away in FIG. 1) to protect the assembly 10 during transport and storage, and a base for elevating the tank 12 above a supporting surface.

Figure 6:
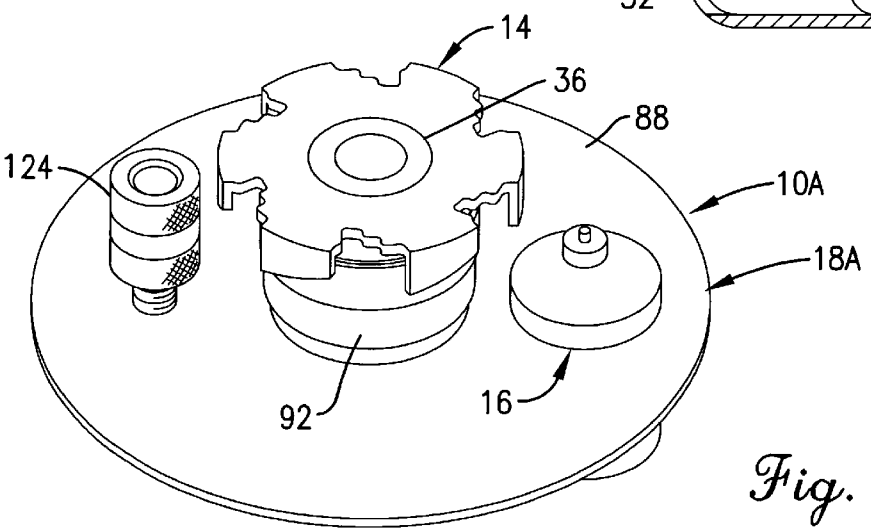
FIG. 6 is a perspective view of a second embodiment of the pressurized tank dispenser hereof including a receiver for pressurized gas mounted on the fitting in addition to the relief valve and dispensing valve.

In an alternative embodiment of the pressurized tank dispenser assembly 10A shown in FIG. 6, the fitting 18A is modified to include an additional opening to threadably receive a quick-connect air hose coupler 124 in addition to the extractor valve 14 and the relief valve component 16. The quick-connect air hose coupler is well known in the art and provides a passage therein to admit pressurized gas such as air to be quickly introduced directly into the tank 12 rather than passing through the extractor valve 14.

The pressurized tank dispenser assemblies 10 and 10A are designed to be used with a coupler 126 illustrated in FIGS. 1 and 2. One coupler 126 particularly suited for use with the present invention is sold by Micro Matic U.S.A., Inc. of Northridge, California as part number 724-085. The coupler 126 has a housing 128 shiftably mounting plunger 130 having a discharge outlet 132 at the upper end thereof. The housing also has a stub 134 having a gas connection in the form of a through hole which fluidically communicates with a central hole generally aligned with and shiftably receiving the plunger 130. A handle 136 actuates the plunger 130 to shift downwardly. The housing 128 is complementally configured with the coupling head 28 of the extractor valve 14, whereby the coupler 126 may be mounted to the extractor valve 14 by positioning the housing 128 in alignment on the onto the coupling head, pushing downwardly, and rotating the coupler in a clockwise direction to attach the bottom of the coupler housing 128 onto the extractor valve 14 in substantially fluid tight relationship. The coupler 126 preferably includes an internal pressure relief valve which is set to release internal pressure at 12 and ½ pounds pressure above atmospheric, and thus serves as a back-up to the second relief valve 58 when the coupler is attached.

In use, the liquid storage chamber 54 of the tank 12 is filled with the pressurized liquid dispenser assembly 10 or 10A in an unmounted condition. The extractor valve 14 is mounted on the fitting as described above with the extraction tube 44 and its extension communicating with the chamber and extending to adjacent the bottom of the tank 12. The gasket 20 is then placed on the neck 112, and the fitting 18 placed over the gasket 20, the plate 88 of the fitting 18 having an exterior surface 138 generally exterior to the tank 12 and an interior surface 140 oriented toward the storage chamber 54 within the tank 12, the portion of the plate adjacent its circular margin engaging the gasket 20. The securement ring 22 is then threaded onto the neck 112 and tightened to inhibit the passage of gas or liquid past the ring 22, gasket 20 and fitting 18. A tamper evident ring may be placed around the outside of the extractor valve 12 body 26, and a cap placed over the extractor valve 14 to inhibit contamination of the extractor valve 14 by debris. The tank 12 with the pressurized gas dispenser assembly 10 installed is then ready for shipment.

When ready for use, the coupler 126 is mounted on the extractor valve 14 as described above. A hose or other source of pressurized gas such as air or carbon dioxide is then connected to the stub 134 or to quick-connect hose coupler 124 when the fitting 18A is used, thereby pressurizing the contents, preferably to less than 10 and ½ pounds pressure above atmospheric. If the pressure exceeds the amount determined by the spring used in the second pressure relief valve 58, excess pressure is bled through the second pressure relief valve 58. A discharge conduit is preferably connected to the discharge outlet 132. Liquid may be discharged from the tank 12 by pressing down on the handle 136, which pushes the plunger 130 against the sealing element 36 to unseat the sealing element 36 and permit liquid to flow there past. The source of pressurized gas may remain connected or be disconnected during discharge of liquid contents of the tank. When sufficient liquid has been discharged, the coupler 126 is detached and, if desired, the storage chamber 54 depressurized by depressing the pin plunger 70 to unseat the check element 66 and permit gas to flow from the storage chamber 54. When the tank 12 is drained, the pressurized gas dispenser assembly is easily removed for cleaning by spinning the securement ring 22 counterclockwise and lifting the fitting 18 with the extractor valve 14 and relief valve component 16 thereon from the tank 12.

As a result, the pressured tank dispenser assembly 10 and 10A provide significant benefits. The extractor valve 14 and relief valve component 16 are mounted to a common fitting 18 which avoids the loss of or damage to separated valve components during normal assembly and cleaning. Additionally, when pressurizing the tank 12, the relief valve integral with the coupler 126 serves as a backup to the relief valve component 16, all carried on a common fitting. Additional gasketing and mounting steps are avoided. Additionally, when using pressurized tank dispenser assembly 10A, one tank may be pressurized while the coupler 126 is attached to a second tank 12 which is dispensing. As a result, construction of the tank 12 may be simplified to provide only a single opening through which introduction and dispensing of liquid, and pressure control may be accomplished, thereby providing improved sealing and less expensive construction.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intention to rely on the Doctrine of Equivalents to determine and assess the reasonably fair scope of their invention as pertains to any apparatus not materially departing from but outside the literal scope of the invention as set out in the following claims.

What is claimed is:

1. A pressurized tank dispenser assembly for mounting to a tank having a liquid storage chamber therein and a hole, the assembly comprising:

a fitting including a plate having an outer margin extending in substantially covering relationship to said hole and presenting first and second openings therein;

a first valve for extracting liquid therethrough positioned in said first opening; and a second pressure regulating valve positioned in said second opening.

2. A pressurized tank dispenser assembly as set forth in claim 1, including a securement member positioned over at least a part of said fitting and adapted for coupling said fitting to the hole.

3. A pressurized tank dispenser assembly as set forth in claim 1, said fitting including a housing substantially surrounding said second pressure regulating valve and having at least one air passage therethrough.

4. A pressurized tank dispenser assembly as set forth in claim 3, wherein said plate includes an exterior surface and an interior surface and said housing includes an upper portion secured to the exterior surface and a lower portion removably mounted below said interior surface.

5. A pressurized tank dispenser as set forth in claim 4, said housing including an intermediate ring fastened to the lower surface of said plate, and wherein said lower portion is threadably coupled to said ring.

6. A pressurized tank dispenser as set forth in claim 2, wherein said securement member is an annular ring having a base and an upright wall, said wall being internally threaded.

7. A pressurized tank dispenser as set forth in claim 1, wherein said plate includes an exterior surface and an interior surface and said second pressure regulating valve includes a tubular valve stem, and a check valve element and a spring positioned within said valve stem, whereby said check valve element is located relatively more proximate the exterior surface than said spring.

8. A pressurized tank dispenser as set forth in claim 7, wherein said fitting includes a housing substantially surrounding said second pressure regulating valve and an actuator shiftably mounted on said housing in alignment with said check valve element for selectively shifting said check valve element out of seating engagement with said valve stem.

9. A pressurized tank dispenser as set forth in claim 8, wherein said plate includes an exterior surface and an interior surface and said second pressure regulating valve includes a tubular valve stem, and a check valve element and a spring positioned within said valve stem, whereby said spring is located relatively more proximate to the exterior surface than said check valve element.

10. A pressurized tank dispenser as set forth in claim 1, wherein said plate includes an exterior surface and an interior surface and said second pressure regulating valve includes a tubular valve stem, and a check valve element and a spring positioned within said valve stem, whereby said spring is located relatively more proximate to the exterior surface than said check valve element.

11. A pressurized tank dispenser as set forth in claim 1, including a quick-connect air hose fitting coupled to said plate for admitting pressurized air into the tank.

12. In combination:

a tank for dispensing liquid under pressure therefrom, said tank defining therein a liquid storage chamber and having a neck presenting a hole for the introduction and discharge of fluids therethrough;

a pressurized tank dispenser including a fitting including a plate having an outer margin extending in substantially covering relationship to said hole and presenting first and second openings therein, a first valve for extracting liquid therethrough positioned in said first opening, and a second pressure regulating valve positioned in said second opening.

13. The combination of claim 12, including an annular securement member threadably coupled to said neck and positioned over at least a part of said plate for removably coupling said pressurized tank dispenser to said tank in substantially fluid-tight relationship.

14. The combination of claim 13, said fitting including a housing substantially surrounding said second pressure regulating valve and having at least one air passage therethrough.

15. The combination of claim 12, wherein said plate includes an exterior surface and an interior surface and said housing includes an upper portion secured to the exterior surface and a lower portion removably mounted below said interior surface.

16. The combination of claim 15, housing including an intermediate ring fastened to the lower surface of said plate, and wherein said lower portion is threadably coupled to said ring.

17. The combination of claim 12, wherein said plate includes an exterior surface and an interior surface and said second pressure regulating valve includes a tubular valve stem, and a check valve element and a spring positioned within said valve stem, whereby said check valve element is located relatively more proximate the exterior surface than said spring.

18. The combination of claim 17, wherein said fitting includes a housing substantially surrounding said second pressure regulating valve and an actuator shiftably mounted on said housing in alignment with said check valve element for selectively shifting said check valve element out of seating engagement with said valve stem.

19. The combination of claim 18, wherein said plate includes an exterior surface and an interior surface and said second pressure regulating valve includes a tubular valve stem, and a check valve element and a spring positioned within said valve stem, whereby said spring is located relatively more proximate to the exterior surface than said check valve element.

20. The combination of claim 12, wherein said plate includes an exterior surface and an interior surface and said second pressure regulating valve includes a tubular valve stem, and a check valve element and a spring positioned within said valve stem, whereby said spring is located relatively more proximate to the exterior surface than said check valve element.

* * * * *